US008270880B2

(12) United States Patent
Kato

(10) Patent No.: US 8,270,880 B2
(45) Date of Patent: Sep. 18, 2012

(54) LIQUID DEVELOPER CARTRIDGE AND IMAGE-FORMING DEVICE

(75) Inventor: Atsushi Kato, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 325 days.

(21) Appl. No.: 12/389,784

(22) Filed: Feb. 20, 2009

(65) Prior Publication Data

US 2009/0220282 A1 Sep. 3, 2009

(30) Foreign Application Priority Data

Feb. 29, 2008 (JP) ..... 2008-049531

(51) Int. Cl.
*G03G 15/10* (2006.01)
*G03G 15/08* (2006.01)

(52) U.S. Cl. ..... 399/238; 399/120; 399/237

(58) Field of Classification Search ..... 399/57, 399/119, 120, 233, 237, 238, 259
See application file for complete search history.

(56) References Cited

U.S. PATENT DOCUMENTS

| | | | | |
|---|---|---|---|---|
| 4,860,050 | A * | 8/1989 | Kurotori et al. | 399/238 |
| 6,151,469 | A * | 11/2000 | Lee | 399/237 |
| 6,249,655 | B1 | 6/2001 | Baek et al. | |
| 6,539,188 | B2 | 3/2003 | Matsumoto et al. | |
| 2003/0147673 | A1 | 8/2003 | Shin et al. | |
| 2006/0008294 | A1 | 1/2006 | Ito et al. | |
| 2007/0047985 | A1 * | 3/2007 | Kamijo et al. | 399/45 |
| 2008/0226339 | A1 | 9/2008 | Sato | |

FOREIGN PATENT DOCUMENTS

| | | | |
|---|---|---|---|
| JP | 05-262394 | | 10/1993 |
| JP | 05-273856 | | 10/1993 |
| JP | 05-273862 | | 10/1993 |
| JP | 08-076601 | | 3/1996 |
| JP | 08-267775 | | 10/1996 |
| JP | 10-301397 | | 11/1998 |
| JP | 11-202728 | | 7/1999 |
| JP | 2000-037884 | | 2/2000 |
| JP | 2000-298402 | | 10/2000 |
| JP | 2001-092260 | * | 4/2001 |
| JP | 2002-091177 | | 3/2002 |
| JP | 2003-270986 | | 9/2003 |
| JP | 2006-053508 | | 2/2006 |
| JP | 2007-017489 | | 1/2007 |
| JP | 2008-216451 | | 9/2008 |

OTHER PUBLICATIONS

Office Action in corresponding Japanese Application 2008-049531 mailed on Jul. 13, 2010.

* cited by examiner

*Primary Examiner* — Sandra Brase
(74) *Attorney, Agent, or Firm* — Banner & Witcoff, Ltd.

(57) ABSTRACT

A liquid developer cartridge detachably mounted in an image forming device includes a first accumulating section and a second accumulating section. The first accumulating section accumulates therein first liquid developer to be supplied to the image forming device. The liquid developer contains developing agent and carrier liquid. The second accumulating section accumulates therein one of the liquid carrier and second liquid developer having a developing agent concentration ratio lower than that of the first liquid developer.

6 Claims, 8 Drawing Sheets

TOP
FRONT
REAR
BOTTOM
10
11
13
15
15A
16
17
18
22
22A
22B
24
25
91
95
95A

LIQUID DEVELOPER CARTRIDGE AND IMAGE-FORMING DEVICE

CROSS REFERENCE TO RELATED APPLICATIONS

This application claims priority from Japanese Patent Application No. 2008-049531 filed Feb. 29, 2008. The entire content of the priority application is incorporated herein by reference.

TECHNICAL FIELD

The present invention relates to a liquid developer cartridge accumulating liquid developer formed of developing agent and liquid carrier, and an image-forming device employing a liquid developing system.

BACKGROUND

An image-forming device using a liquid developing method such as that disclosed in Japanese unexamined patent application publication No. 2003-270986, is well-known in the art. In general, this image-forming device forms images using liquid developer having developing agent dispersed in liquid carrier. Since the image-forming device using the liquid developing method can employ a finer developing agent, the image-forming device can form images of higher resolution.

Consideration has been given to a structure for detachably (replaceably) mounting liquid developer cartridges accumulating liquid developer in the body of the image-forming device in order to facilitate the supply of liquid developer to the image-forming device. However, since the developer used in this type of image-forming device is in a liquid state, this image-forming device places a burden on the user that is nonexistent in image-forming devices employing only a developing agent (i.e., a solid developing agent).

Liquid developer is formed of a developing agent dispersed in liquid carrier, for example. Since the developing agent is primarily transferred onto the recording sheet during image formation, the amount of developing agent dispersed in the liquid carrier decreases, changing the concentration of the liquid developer. To compensate for this change in concentration, the image-forming device using a liquid developing system is provided with a configuration for adjusting the concentration of the liquid developer. Since liquid carrier is required for adjusting the concentration, a structure must be provided to supply and accumulate the liquid carrier separate from the liquid developer.

When the liquid carrier for adjusting the concentration of the liquid developer is supplied in a cartridge, this causes an operational burden on the user for replacing the liquid carrier cartridge in addition to the liquid developer cartridges, and an economical burden on the user for purchasing the liquid carrier cartridge.

SUMMARY

In view of the foregoing, it is an object of the present invention to provide a liquid developer cartridge and an image-forming device capable of reducing the user's burden.

In order to attain the above object, the invention provides a liquid developer cartridge. The liquid developer cartridge detachably mounted in an image forming device includes a first accumulating section and a second accumulating section. The first accumulating section accumulates therein first liquid developer to be supplied to the image forming device. The liquid developer contains developing agent and carrier liquid. The second accumulating section accumulates therein one of the liquid carrier and second liquid developer having a developing agent concentration ratio lower than that of the first liquid developer.

According to another aspect, the present invention provides an image forming device. The image forming device includes a casing, a plurality of developer cartridges, a plurality of developing agent bearing members, and a plurality of reservoirs. The plurality of developer cartridges are each detachably mounted in the casing and accumulate therein liquid developer containing developing agent and liquid carrier. The plurality of developing agent bearing members bear the liquid developer. The plurality of reservoirs are each fluidly connected to associated one of the developer cartridges for storing the liquid developer to be supplied to the developing agent bearing members. One of the developer cartridges includes a first accumulating section and a second accumulating section. The first accumulating section accumulates therein first liquid developer and is fluidly connected to associated one of the reservoirs. The second accumulating section is fluidly connected to associated one of the reservoirs and accumulates therein one of the liquid carrier and second liquid developer having a developing agent concentration ratio lower than that of the first liquid developer. Remaining developer cartridges each comprises liquid developer accumulating section accumulating the liquid developer and fluidly connected to associated one of the reservoirs.

DETAILED DESCRIPTION

Next, an embodiment of the present invention will be described while referring to the accompanying drawings.

Figure 1:
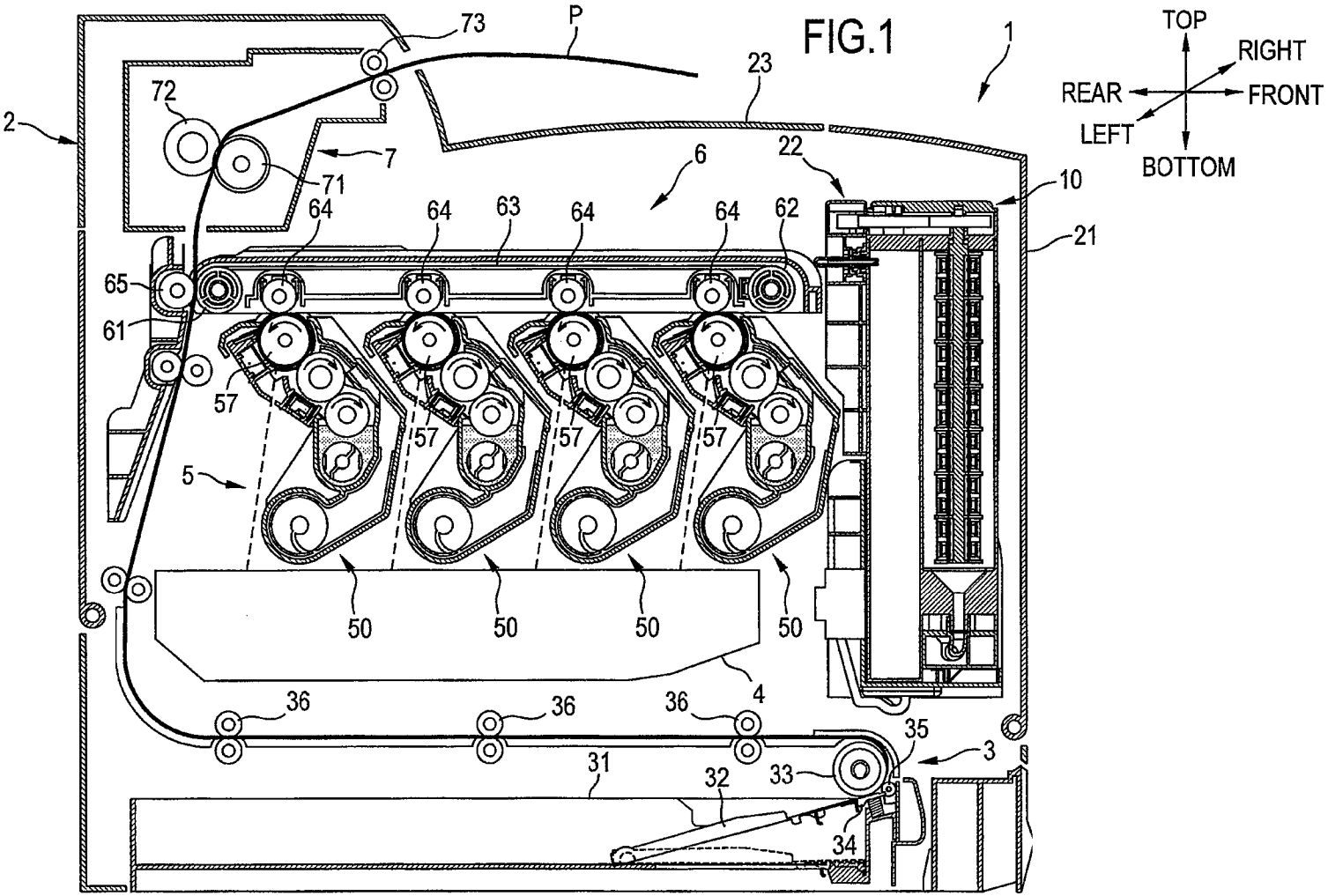
FIG. 1 is a cross-sectional view showing the overall structure of a color printer serving as one embodiment of the present invention of an image-forming device.

In the following description, directions will be described based on the position of the user when the user is using the color printer and when the user is supplying liquid developer (or liquid carrier). In FIG. 1, for example, the right side of the drawing will be referred to as the "front" side, the left side as the "rear" side, the far side of the drawing as the "right" side, and the near side as the "left" side. In addition, the top and bottom sides of the drawing will be referred to as the "top" and "bottom," respectively.

Figure 2:
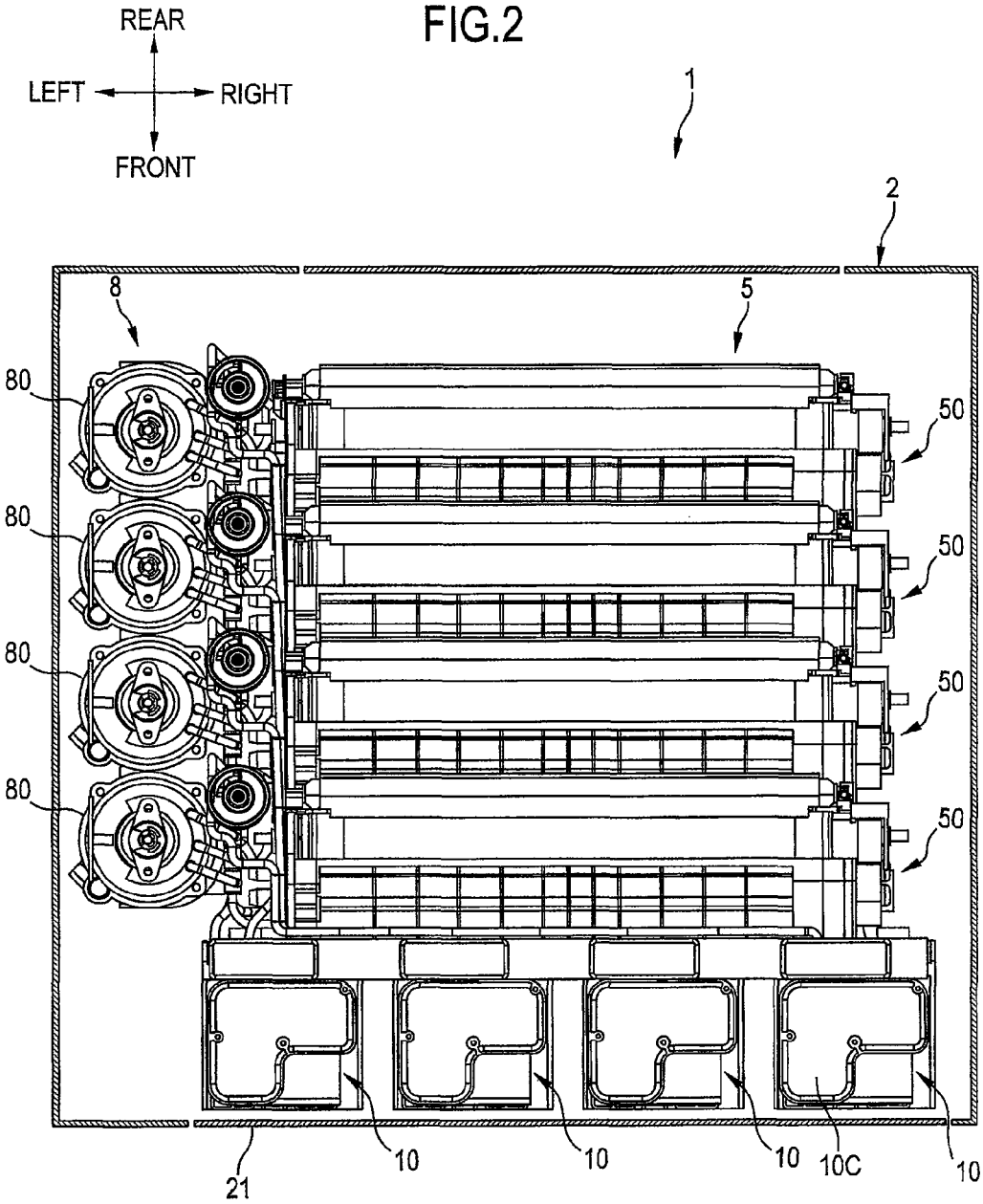
FIG. 2 is a plan view of a process section, a regulating section, and a liquid developer cartridge.

As shown in FIG. 1, a color printer 1 has a main casing 2 constituting a device body. Within the main casing 2, the color printer 1 includes a feeding section 3 for feeding a paper P into the color printer 1, an exposure section 4, a process section 5, a transfer section 6 for transferring images on the paper P fed from the feeding section 3, and a fixing section 7. As shown in FIG. 2, the color printer 1 also includes a regulating section 8 for regulating the concentration of liquid developer supplied to the process section 5, and four liquid developing cartridges 10 detachably mounted for the casing 2.

As shown in FIG. 1, the main casing 2 includes a front cover 21 on the front side thereof capable of rotating forward and backward about a support point on the bottom of the front cover 21, and a cartridge mounting section 22 formed in the front side thereof in which the liquid developer cartridges 10 are detachably mounted. A discharge tray 23 is provided on the top of the main casing 2 for accumulating the paper P discharged from the main casing 2. Here, the "concentration of the liquid developer" denotes the ratio of the mass of developing agent to the mass of the overall liquid developer.

The feeding section 3 will be described in detail. The feeding section 3 is disposed in the bottom section of the main casing 2 and includes a paper cassette 31 that can be withdrawn from the main casing 2 in the forward direction, a paper-pressing plate 32 disposed in the paper cassette 31, a feeding roller 33, a separation pad 34, a paper dust roller 35 disposed above the front side of the paper cassette 31, and a plurality of pairs of conveying rollers 36 disposed above the paper cassette 31 at intervals in the front-to-rear direction. The paper-pressing plate 32 in the feeding section 3 pushes the paper P accommodated in the paper cassette 31 toward the feeding roller 33. The feeding roller 33 and the separation pad 34 cooperate to feed the paper P one sheet at a time onto a conveying channel that passes by the paper dust roller 35 and the pairs of conveying rollers 36 and continues downstream to the transfer section 6.

Details of the exposure section 4 will be described. The exposure section 4 is disposed above the paper cassette 31 between the paper cassette 31 and the process section 5. The exposure section 4 has a construction well known in the art that includes laser light-emitting units, a polygon mirror, a plurality of lenses, and a plurality of reflecting mirrors, none of which are shown in the drawings. The laser light-emitting units in the exposure section 4 project laser beams to the process section 5.

Details of the process section 5 will be described. The process section. 5 is disposed above the exposure section 4 and between the exposure section 4 and the transfer section 6. The process section 5 is configured of four process units 50 juxtaposed in the front-to-rear direction.

The process units 50 all have the same construction, differing only in the color of toner, i.e., the solid particles in the liquid developer supplied from the regulating section 8. The liquid developer is formed by dispersing toner as an example of a developing agent in a nonvolatile liquid carrier.

Figure 3:
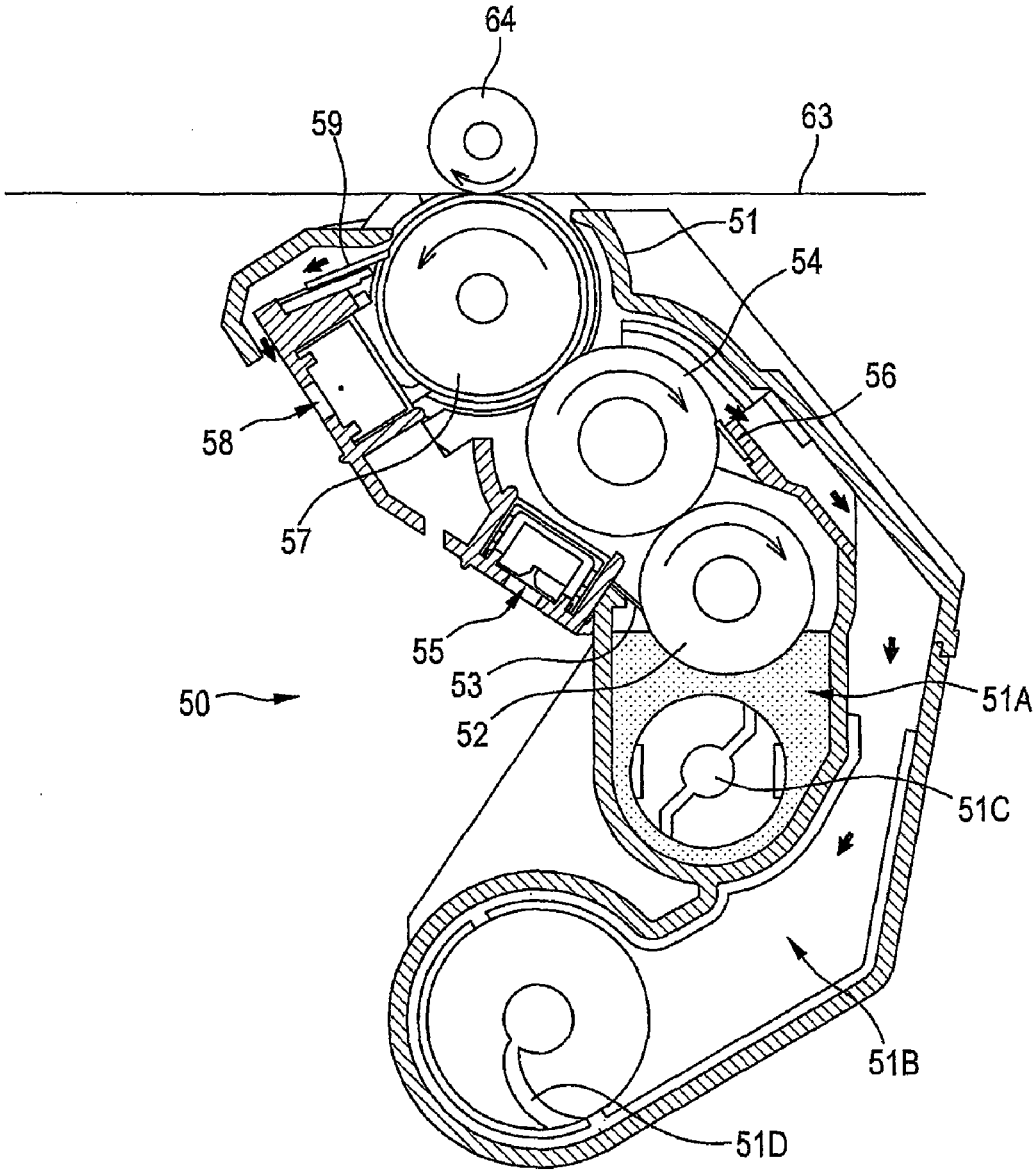
FIG. 3 is an enlarged view of a process unit.

As shown in FIG. 3, each of the process units 50 is primarily configured of a frame 51 constituting the outer structure and, within the frame 51, a supply roller 52, a first blade 53 for regulating the thickness of liquid developer on the supply roller 52, a developing roller 54, a first charger 55, a second blade 56 for returning the liquid developer on the developing roller 54, a photosensitive drum 57, a second charger 58, and a third blade 59 for removing the waste liquid developer on the photosensitive drum 57.

In addition to forming the outer structure of the process unit 50, the frame 51 also configures a first reservoir 51A for retaining the liquid developer to be supplied to the supply roller 52, and a second reservoir 51B for retaining liquid developer collected from the developing roller 54.

As shown in FIG. 3, agitators 51C and 51D are provided in the first and second reservoirs 51A and 51B, respectively. The agitators 51C and 51D agitate the liquid developer stored in the respective reservoir in order to uniformly disperse toner in the liquid carrier. The action of the agitators 51C and 51D charges the toner dispersed in the liquid carrier at this time.

The supply roller 52 is a metal roller in the surface of which is formed a plurality of grooves (not shown) running in the circumferential direction of the roller. The supply roller 52 rotates while carrying liquid developer stored in the first reservoir 51A on the surface thereof in order to supply the liquid developer to the developing roller 54.

The first blade 53 slidingly contacts the surface of the rotating supply roller 52 at a position upstream of the position that the supply roller 52 slidingly contacts the developing roller 54 relative to the rotating direction of the supply roller 52. The first blade 53 functions to regulate the thickness of the liquid developer carried on the surface of the supply roller 52.

The developing roller 54 carries liquid developer supplied from the supply roller 52 on the surface thereof and supplies this liquid developer to an electrostatic latent image formed on the surface of the photosensitive drum 57 in order to form a toner image on the photosensitive drum 57.

The first charger 55 is disposed at a position away from the developing roller 54 by a prescribed distance opposing to the developing roller 54. The first charger 55 functions to attract toner within the liquid developer carried on the developing roller 54 toward the surface of the liquid carrier (or toward the surface of the developing roller 54).

The second blade 56 slidingly contacts the surface of the rotating developing roller 54 at a position downstream from the position at which the developing roller 54 slidingly contacts the photosensitive drum 57 relative to the rotating direction of the developing roller 54. The second blade 56 functions to recover liquid developer remaining on the developing roller 54. The recovered liquid developer is collected in the second reservoir 51B.

A laser beam irradiated from the exposure section 4 onto the surface of the photosensitive drum 57 forms an electrostatic latent image thereon. The toner in the liquid developer supplied from the supply roller 52 to the photosensitive drum 57 via the developing roller 54 develops the electrostatic latent image on the photosensitive drum 57 into a visible toner image.

The second charger 58 is disposed at a position away from the photosensitive drum 57 at a prescribed distance so as to oppose but not contact the photosensitive drum 57. The second charger 58 functions to apply a uniform charge to the surface of the photosensitive drum 57.

The third blade 59 slidingly contacts the surface of the rotating photosensitive drum 57 at a position immediately above the second charger 58 and upstream of the second charger 58 relative to the rotational direction of the photosensitive drum 57. The third blade 59 functions to remove liquid developer remaining on the photosensitive drum 57 after a transfer operation. The liquid developer remaining on the photosensitive drum 57 after the transfer operation (referred to as waste liquid developer) includes a mixture of paper dust and toner in different colors.

Details of the transfer section 6 will be described. As shown in FIG. 1, the transfer section 6 is disposed immediately above the process section 5, and more specifically between the process section 5 and the discharge tray 23. The transfer section 6 is provided with a drive roller 61, a follow roller 62, an intermediate transfer belt 63, four primary transfer rollers 64, and a secondary transfer roller 65.

The drive roller 61 and follow roller 62 are arranged parallel to one another and separated in the front-to-rear direction. An endless intermediate transfer belt 63 is looped around the drive roller 61 and follow roller 62. The photosensitive drums 57 oppose and contact the outer surface of the intermediate transfer belt 63 on the bottom thereof, while the secondary transfer roller 65 opposes and contacts the outer surface of the intermediate transfer belt 63 on the rear side. The follow roller 62 is urged in the forward direction in order to apply tension to the intermediate transfer belt 63.

Each of the primary transfer rollers 64 is disposed in opposition to one of the photosensitive drums 57 and contacts the inner bottom surface of the intermediate transfer belt 63 pinching the intermediate transfer belt 63 against the photosensitive drum 57. The secondary transfer roller 65 is disposed in opposition to the drive roller 61 pinching the intermediate transfer belt 63 against the drive roller 61. During a transfer operation, a transfer bias is applied to the primary transfer rollers 64 and the secondary transfer roller 65.

With the process section 5 and transfer section 6 having the above construction, each second charger 58 first applies a uniform charge to the surface of the respective photosensitive drum 57, and the surface of the photosensitive drum 57 is subsequently exposed to a laser beam emitted from the exposure section 4 based on image data. Irradiating the surface of the photosensitive drum 57 with a laser beam lowers the potential in the exposed areas, thereby forming an electrostatic latent image on the photosensitive drum 57.

As the supply roller 52 rotates, liquid developer stored in the first reservoir 51A is carried on the surface of the supply roller 52 and is supplied to the developing roller 54 as the surface of the supply roller 52 rotates in contact with the surface of the developing roller 54. As the surface of the developing roller 54 rotates in contact with the surface of the photosensitive drum 57, toner in the liquid developer carried on the developing roller 54 is supplied to the electrostatic latent image formed on the photosensitive drum 57.

In this way, the toner is selectively carried on the photosensitive drum 57, developing the electrostatic latent image into a visible toner image. By applying a transfer bias to each primary transfer roller 64, the primary transfer rollers 64 function to sequentially transfer toner images in each color formed on the photosensitive drums 57 onto the intermediate transfer belt 63 so that the toner images are superimposed over each other. When a transfer bias is applied to the secondary transfer roller 65, the secondary transfer roller 65 causes the toner images transferred onto the intermediate transfer belt 63 to be transferred onto a sheet of paper P conveyed from the feeding section 3 as the sheet of paper P passes between the intermediate transfer belt 63 and the secondary transfer roller 65.

Details of the fixing section 7 will be described. The fixing section 7 is provided above the rear side of the transfer section 6. The fixing section 7 includes a heating roller 71, a pressure roller 72 disposed in opposition to the heating roller 71 and applying pressure to the same, and a pair of discharge rollers 73. After the toner images are transferred onto a sheet of paper P, the toner images are fixed to the sheet by heat in the fixing section 7 as the sheet passes between the heating roller 71 and pressure roller 72. The discharge rollers 73 subsequently discharge the sheet of paper P out of the main casing 2, where the sheet is accumulated on the discharge tray 23.

Details of the regulating section 8 will be described. The regulating section 8 is disposed on the left side of the process section 5 as shown in FIG. 2. The regulating section 8 includes four regulating tanks 80 (see FIG. 4) juxtaposed in the front-to-rear direction on the left side of the respective process units 50 and an agitator 81 for agitating each regulating tank 80.

The agitator 81 is provided in each regulating tank 80. Although some parts of the structure are omitted in FIG. 4, each regulating tank 80 is linked to the respective first reservoir 51A by a first supply channel 93, and to the respective second reservoir 51B by a first recovery channel 94.

Figure 4:
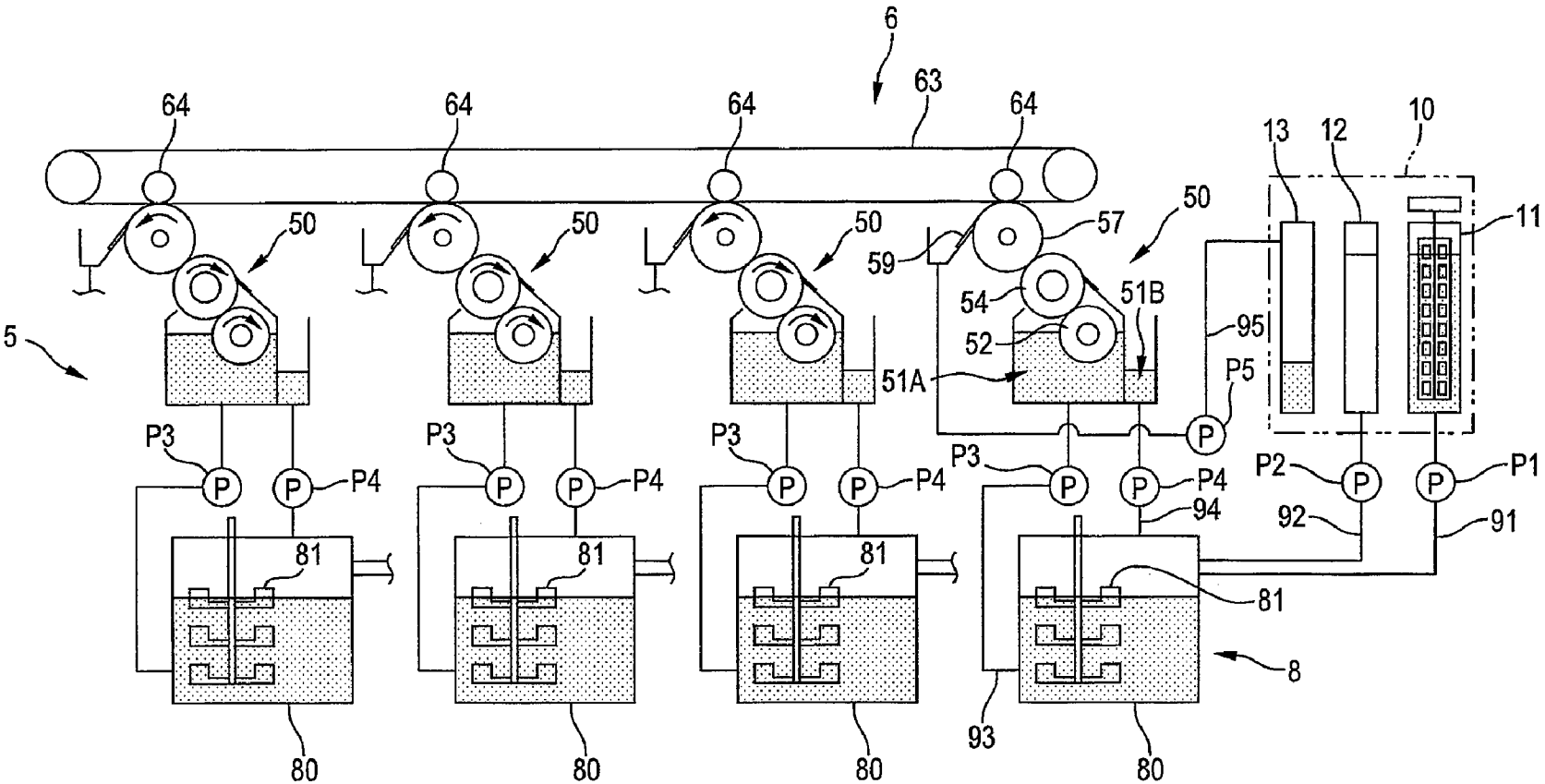
FIG. 4 is an explanatory diagram conceptually illustrating the configuration of the process section and the regulating section.

As shown in FIG. 4, a pump P3 is adapted for supplying liquid developer to the first reservoir 51A after the concentration of the liquid developer has been regulated in a regulating tank 80 of the regulating section 8 through the first supply channel 93. A pump P4 is adapted for feeding liquid developer collected from the second reservoir 51B to the regulating tank 80 of the regulating section 8 through the first recovery channel 94.

As shown in FIG. 2, four liquid developer cartridges 10 are disposed forward of the process section 5. The liquid developer cartridge 10 includes a liquid developer accommodating unit 11, a liquid carrier accommodating unit 12, and a waste liquid developer accommodating unit 13. As shown in FIG. 4, the liquid developer accommodating unit 11 is linked to the corresponding regulating tank 80 by a second supply channel 91. The liquid carrier accommodating unit 12 is linked to the each regulating tank 80 by a third supply channel 92. A pump P1 is adapted for supplying the liquid developer to the regulating tank 80. A pump P2 is adapted for supplying the liquid carrier to the regulating tank 80.

A pump P5 is provided for conveying the waste liquid developer removed by the third blade 59 along a second recovery channel 95 for recovering the waste liquid developer. The waste liquid developer is subsequently recovered in the waste liquid developer accommodating unit 13. Although part of the structure is omitted in FIG. 4, each of the process units 50 is coupled to the waste liquid developer accommodating unit 13 in the liquid developer cartridge 10 by the second recovery channel 95 on which the pump P5 is provided.

Here, the method of regulating the concentration of liquid developer in the regulating tank 80 will be described below. In addition to the agitator 81, the regulating tank 80 is provided with a liquid level sensor for detecting the surface height of the liquid developer, a viscosity sensor mounted on the agitator 81 for detecting the viscosity of the liquid developer, and a pump controller for controlling the pumps P1-P4 based primarily on the sensors' output values (the sensors and pump controller are not shown in the drawings).

After liquid developer recovered from the developing roller 54 is transferred from the second reservoir 51B via the first recovery channel 94 and collected in the regulating tank 80, the pump P1 supplies liquid developer from the liquid developer accommodating unit 11 to the regulating tank 80 via the second supply channel 91 until the liquid developer in the regulating tank 80 reaches a prescribed volume (a prescribed height). Next, the concentration of the liquid developer in the regulating tank 80 (the amount of toner in the liquid carrier) is calculated by driving the agitator 81 in order to measure the viscosity of the liquid developer. While the agitator 81 is continually driven, the pump P2 supplies liquid carrier from the liquid carrier accommodating unit 12 via the third supply channel 92 (or the pump P1 supplies liquid developer from the liquid developer accommodating unit 11 via the second supply channel 91) until the concentration of the liquid developer reaches a preset value. After the concentration of the developer is adjusted, the pump P3 supplies the liquid developer from the regulating tank 80 to the first reservoir 51A via the first supply channel 93.

Next, a detailed structure of the liquid developer cartridge 10 will be described. Directions used in the following description will be based on the state of the liquid developer cartridge 10 mounted in the main casing 2 (see FIG. 1).

Figure 5:
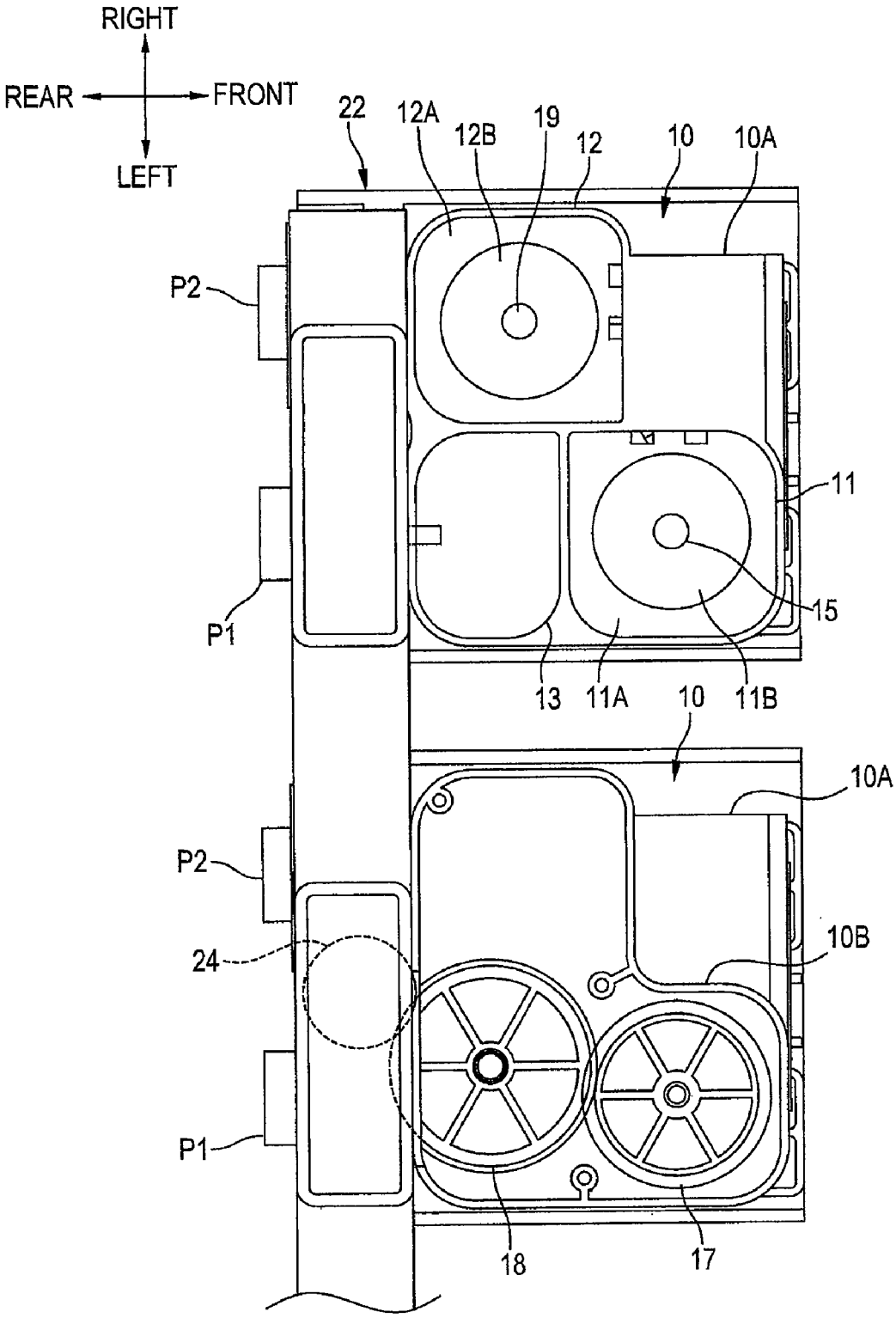
FIG. 5 is a plan view of a liquid developer cartridge with a gearbox removed and a liquid developer cartridge with an upper cover removed.
Figure 6:
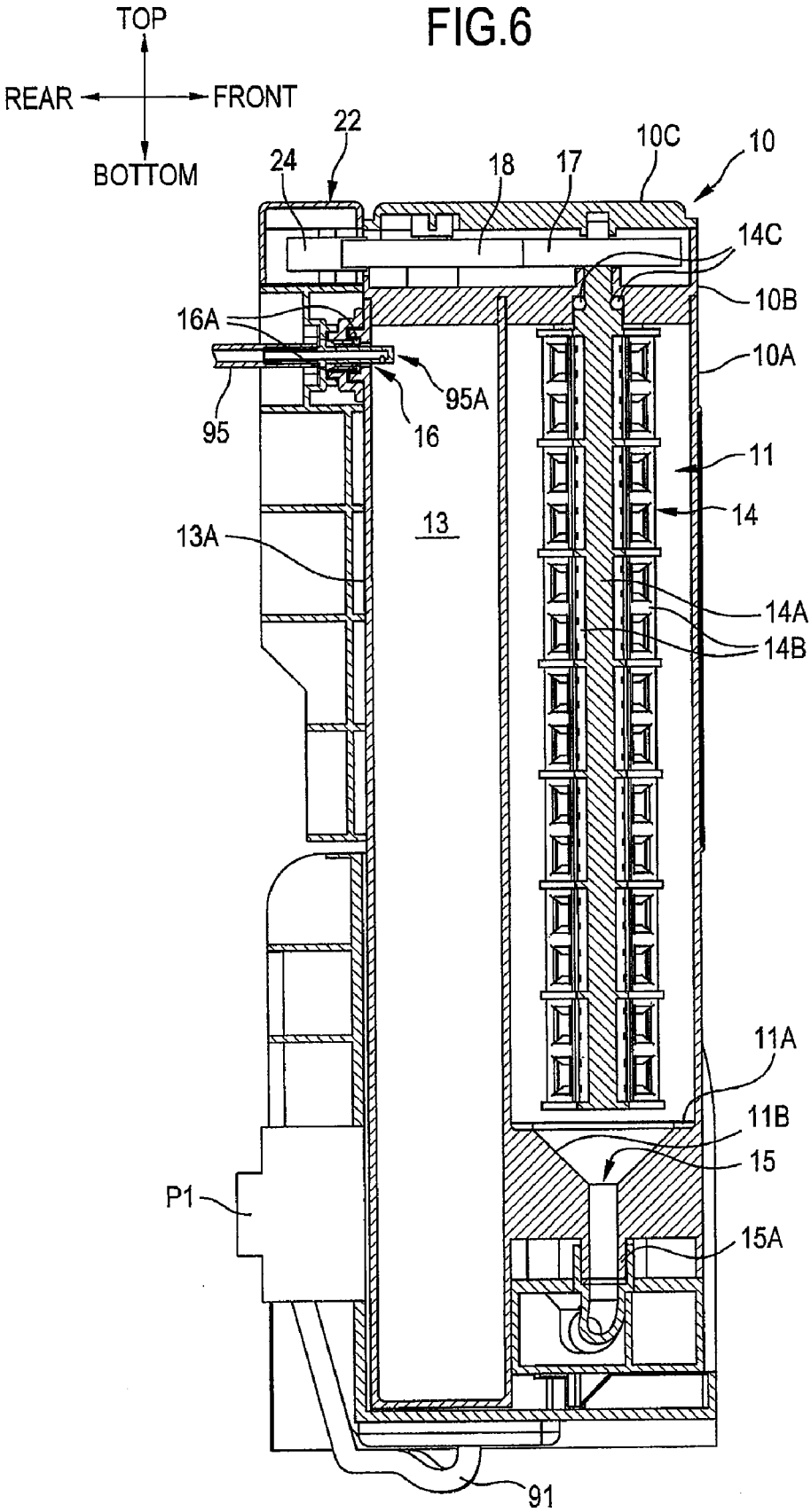
FIG. 6 is a cross-sectional view of the liquid developer cartridge.

As shown in FIGS. 5 and 6, the liquid developer cartridge 10 primarily includes a cartridge frame 10A, a gearbox 10B, and an upper cover 10C.

The liquid developer accommodating unit 11, the liquid carrier accommodating unit 12, and the waste liquid developer accommodating unit 13 are formed in the cartridge frame 10A.

More specifically, as shown in the upper portion of FIG. 5, the waste liquid developer accommodating unit 13 and the liquid carrier accommodating unit 12 are juxtaposed in the left-to-right direction in the rear of the cartridge frame 10A, and the liquid developer accommodating unit 11 is formed on the front side of the waste liquid developer accommodating unit 13. The accommodating units 11, 12, and 13 are substantially cylindrical in shape and elongated vertically, and are open on the top. In the embodiment, the accommodating units 11 and 12 are formed with substantially the same accommodating capacity, while the accommodating unit 13 is formed with a slightly smaller capacity than the accommodating unit 11 or 12.

The liquid developer accommodating unit 11 serves to accumulate liquid developer that will be supplied into the color printer 1 (the regulating tank 80). The liquid developer accommodating unit 11 accumulates a liquid developer having a high concentration than that of the liquid developer accumulated in the first reservoir 51A of the process unit 50. As shown in FIG. 6, an agitator 14 is disposed inside the liquid developer accommodating unit 11, and an outlet 15 is formed at the bottom end (bottom surface 11A) of the liquid developer accommodating unit 11.

The agitator 14 is configured of a shaft 14A, and two agitating blades 14B. The agitator 14 functions to uniformly disperse toner in liquid developer (liquid carrier) by agitating the liquid developer accumulated in the liquid developer accommodating unit 11.

The shaft 14A extends vertically in the liquid developer accommodating unit 11, with the upper end rotatably supported in the gearbox 10B described later. A seal 14C is disposed between the upper end of the shaft 14A and the gearbox 10B for hermetically sealing the space therebetween. The agitating blades 14B are fixed on opposite sides of the shaft 14A.

The outlet 15 allows liquid developer accumulated in the liquid developer accommodating unit 11 to flow out therefrom. A valve (not shown) is provided in the outlet 15 to switch the relationship of the interior and exterior of the liquid developer accommodating unit 11 between a communicating state when the liquid developer cartridge 10 is mounted on the main casing 2 and a non-communicating state when the liquid developer cartridge 10 is detached from the main casing 2. A funnel-shaped part 11B is provided on the bottom surface 11A of the liquid developer accommodating unit 11 and has a surface that grows narrower from the bottom surface 11A to the edge of the opening in the outlet 15. A cartridge-side mounting part 15A is in fluid communication with the outlet 15 and protrudes cylindrically from the region bottom of the cartridge frame 10A.

The liquid carrier accommodating unit 12 serves to accumulate liquid carrier that will be supplied into the color printer 1 (regulating tank 80). An outlet 19 having the same structure as the outlet 15 formed on the liquid developer accommodating unit 11 is formed on a bottom surface 12A of the liquid carrier accommodating unit 12. A funnel-shaped part 12B is provided on the bottom surface 12A and has a surface that grows narrower from the bottom surface 12A to the edge of the opening in the outlet 19 (see FIG. 5).

The waste liquid developer accommodating unit 13 functions to accumulate waste liquid developer collected from the color printer 1. As shown in FIG. 6, an inlet 16 is formed in the upper portion of the waste liquid developer accommodating unit 13 so as to penetrate a side wall 13A of the waste liquid developer accommodating unit 13 in the front-to-rear direction.

The inlet 16 functions to receive waste liquid developer. More specifically, when the liquid developer cartridge 10 is mounted on the main casing 2, an end 95A of the second recovery channel 95 is inserted into the inlet 16. Waste liquid developer conveyed into the second recovery channel 95 passes through the end 95A and the inlet 16 and is collected in the waste liquid developer accommodating unit 13. A valve (not shown) is provided in the inlet 16 for switching the relationship of the interior and exterior of the waste liquid developer accommodating unit 13 between a communicating state when the liquid developer cartridge 10 is mounted on the main casing 2 and the end 95A is inserted in the inlet 16 and a non-communicating state when the liquid developer cartridge 10 is removed from the main casing 2 and the end 95A is removed from the inlet 16. A seal 16A is provided in the inlet 16 for hermetically sealing the space between the inlet 16 and the second recovery channel 95.

A sensor (not shown; also referred to as an "empty sensor") is provided in each of the accommodating units 11, 12, and 13 for detecting the level of liquid. The color printer 1 is provided with a display unit (not shown) for displaying information on the liquid levels detected by the sensors. Hence, the user can replace the liquid developer cartridges 10 based on this information.

The gearbox 10B is substantially box-shaped with an open top and also functions as a cover when mounted on the top of the cartridge frame 11A for covering the accommodating units 11, 12, and 13. An input gear 17 and an intermediate gear 18 are provided in the gearbox 10B for transmitting a drive force to the agitator 14.

The input gear 17 is disposed above the liquid developer accommodating unit 11 and is fixed to the top end of the shaft 14A in the agitator 14 that protrudes through the bottom surface of the gearbox 10B. The intermediate gear 18 is disposed above the waste liquid developer accommodating unit 13 and is engaged with the input gear 17. When the liquid developer cartridge 10 is mounted on the main casing 2, the intermediate gear 18 engages with a drive gear 24 provided in an upper portion of the cartridge mounting section 22. The drive gear 24 is coupled with a motor (not shown) provided in the main casing 2. When the motor drives the drive gear 24 to rotate, the intermediate gear 18 transmits this drive force to the input gear 17, and the input gear 17 drives the agitator 14 (shaft 14A) to rotate. Consequently, the agitator 14 agitates the liquid developer in the liquid developer accommodating unit 11.

The upper cover 10C is attached to the top of the gearbox 10B for covering the input gear 17 and the intermediate gear 18.

Next, a structure for mounting the liquid developer cartridge 10 in and removing the liquid developer cartridge 10 from the main casing 2 will be described briefly.

Figures 7A, 7B, 7C:
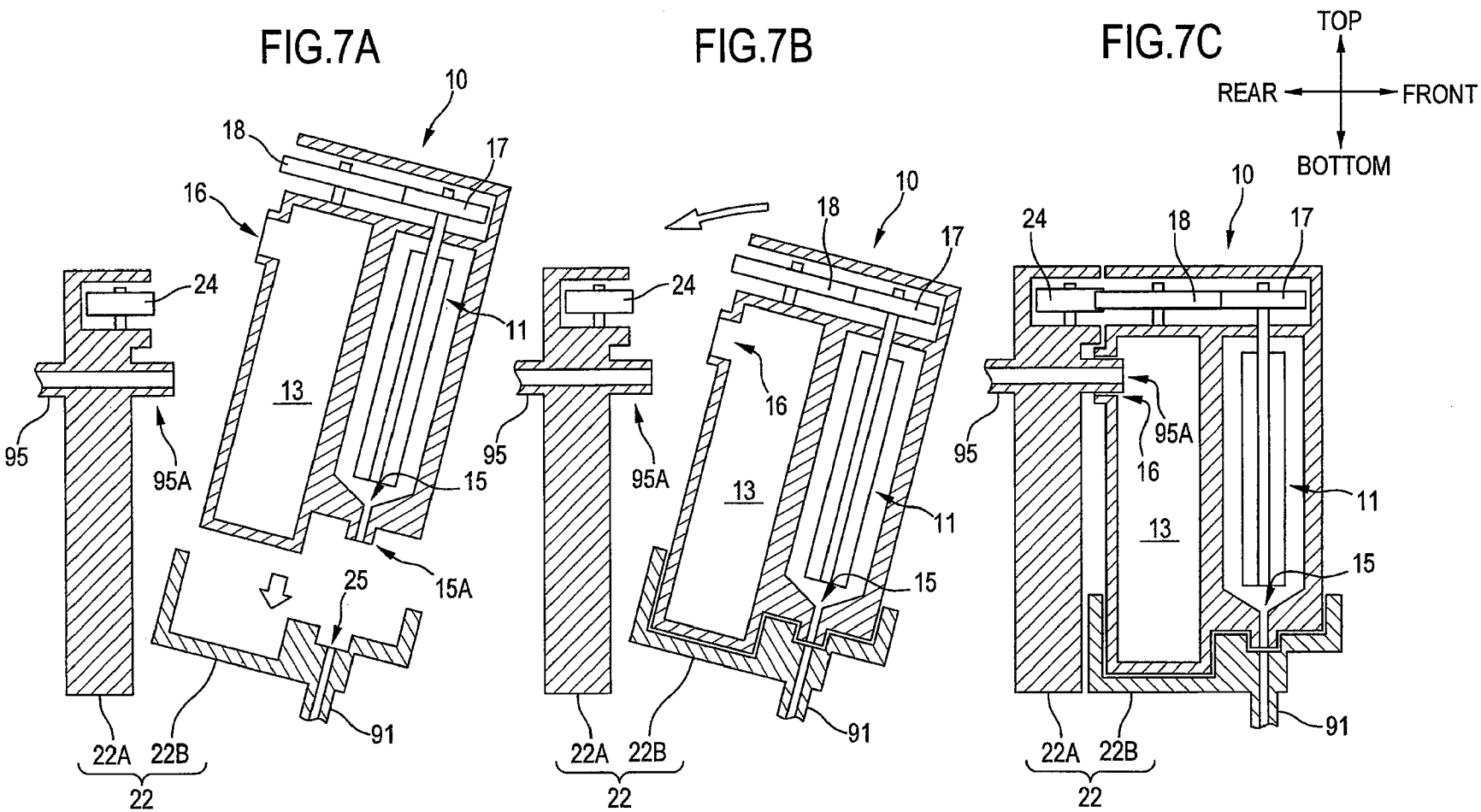
FIGS. 7A-7C are explanatory diagrams illustrating the operation of a mechanism for mounting and removing the liquid developer cartridge.

As shown in FIG. 7A, the cartridge mounting section 22 primarily includes a stationary part 22A including the drive gear 24 and the end 95A of the second recovery channel 95, and a pivoting part 22B disposed in front of the bottom portion of the stationary part 22A and capable of pivoting in the front-to-rear direction.

A body-side mounting part 25 is provided on the pivoting part 22B. The cylindrical cartridge-side mounting part 15A is formed to mount in the body-side mounting part 25. The body-side mounting part 25 is in fluid communication with the second supply channel 91. While not shown in the drawings, the same structure is provided for the carrier liquid accommodating unit 12 so that a cartridge-side mounting part on the outlet 19 of the carrier liquid accommodating unit 12 mounts in a body-side mounting part that is in fluid communication with the third supply channel 92.

When mounting the liquid developer cartridge 10 on the main casing 2 (cartridge mounting section 22), first the cartridge-side mounting parts 15A are mounted in the body-side mounting parts 25 so that the liquid developer cartridge 10 is resting on the pivoting part 22B in a forwardly pivoted state. At this point, the openings in the outlet 15 and the corresponding body-side mounting parts 25 are in fluid communication, as shown in FIG. 7B, and hence the inside of the liquid developer accommodating unit 11 is in fluid communication with the second supply channel 91 and the inside of the carrier liquid accommodating unit 12 is in fluid communication with the second supply channel 92.

Next, the pivoting part 22B is pivoted rearward by pushing the liquid developer cartridge 10 rearward (toward the stationary part 22A). At this point, the intermediate gear 18 is engaged with the drive gear 24, and the end 95A of the second recovery channel 95 penetrates the inlet 16 so that the interior of the waste liquid developer accommodating unit 13 is in fluid communication with the second recovery channel 95, as shown in FIG. 7C.

When removing the liquid developer cartridge 10 from the main casing 2 (cartridge mounting section 22), the cartridge mounting section 22 is first pivoted forward by pulling the liquid developer cartridge 10 forward. Next, the liquid developer cartridge 10 is removed from the pivoting part 22B by lifting the liquid developer cartridge 10 upward. Accordingly, in just two operations, the liquid developer cartridge 10 can be mounted in or removed from the main casing 2 in the front-to-rear direction, which is the same direction for mounting and removing the paper cassette 31 (see FIG. 1).

Since the liquid developer cartridge 10 is integrally provided with the accommodating units 11, 12, and 13, this structure eliminates the need to purchase or replace cartridges other than the liquid developer cartridge 10. In other words, use of the liquid developer cartridge 10 reduces the types of cartridges used as consumables and can therefore reduce the operational and economical burden on the user. Further, since the liquid developer cartridge 10 is configured primarily of only the accommodating units 11, 12, and 13, the overall cartridge can be made less expensive than a cartridge additionally provided with a developing roller, supply roller, and the like, thereby reducing the economical burden on the user.

By providing the outlets 15 and 19 in the bottom surfaces 11A and 12A of the accommodating units 11 and 12, all of the liquid developer and liquid carrier accumulated in the accommodating units 11 and 12 can be used entirely without waste. In other words, the liquids are used more effectively than when the outlets are provided in a side wall or the top of the accommodating units and the liquid is suctioned by a pump. Further, since the force of gravity can be used to supply the liquid developer or the liquid carrier, a large pump is not required, thereby reducing power consumption and contributing to make the color printer 1 more compact.

By forming the inlet 16 in the upper portion of the side wall 13A on the waste liquid developer accommodating unit 13 rather than providing the inlet on the bottom, it is possible to reduce the cost of the seal 16A and to prevent the likelihood of waste liquid developer from leaking due to fluid pressure applied to the inlet 16. Even though a plurality of openings (the outlets 15, 16, and the inlet 16) are provided in the liquid developer cartridge 10, forming the inlet 16 in the side wall 13A of the waste liquid developer accommodating unit 13 makes it possible to employ a simple mounting and detaching mechanism for mounting and detaching the liquid developer cartridge 10 through two operations.

By providing the gears 17 and 18 above the liquid developer accommodating unit 11 for transmitting a drive force to the agitator 14, rather than providing a drive force transmission mechanism on a shaft protruding from the bottom of the accommodating unit, the seal 14 provided on the bearing portion of the shaft 14A can be simplified. Simplifying the structure of this bearing part can reduce the cost of the seal 14C. This configuration is also advantageous in that liquid developer is unlikely to leak from the accommodating unit.

Since interference between the inlet 16 and the gears 17 and 18 is avoided by providing the inlet 16 in the side wall 13A of the waste liquid developer accommodating unit 13, the overall structure of the liquid developer cartridge 10 can be simplified. Since, a liquid developer in the liquid developer accommodating unit 11 is a higher concentration than that of the liquid developer stored in the first reservoir 51A, the range of concentration regulation in the regulating section 8 is expanded. Further, since the mounting and removing direction of the liquid developer cartridge 10 is identical to the mounting and removing direction of the paper cassette 31 (the front-to-rear direction), the user can both replace the liquid developer cartridge 10 and load the paper P from the front of the color printer 1, making the color printer 1 more user-friendly.

While the invention has been described in detail with reference to specific embodiments thereof, it would be apparent to those skilled in the art that many modifications and variations may be made therein without departing from the spirit of the invention, the scope of which is defined by the attached claims.

In the embodiment described above, all four liquid developer cartridges 10 mounted in the color printer 1 are integrally configured of the accommodating units 11, 12, and 13, but the image-forming device of the present invention is not limited to this construction.

Figure 8A:
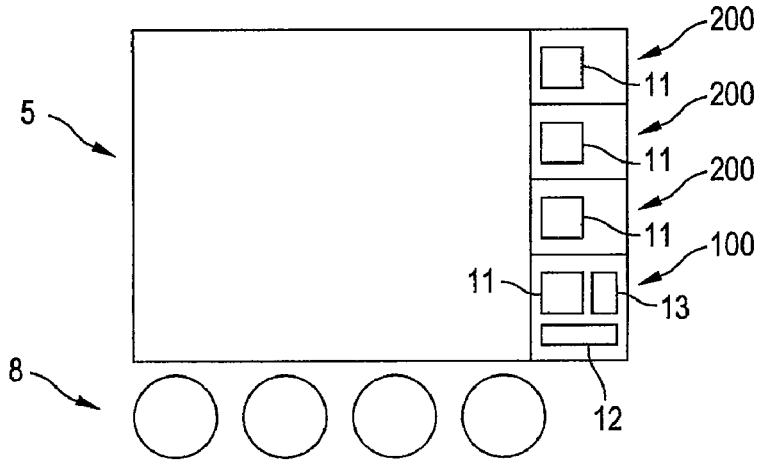
FIGS. 8A-8C are plan views conceptually showing the color printer according to a variation of the embodiment.
Figure 8B:
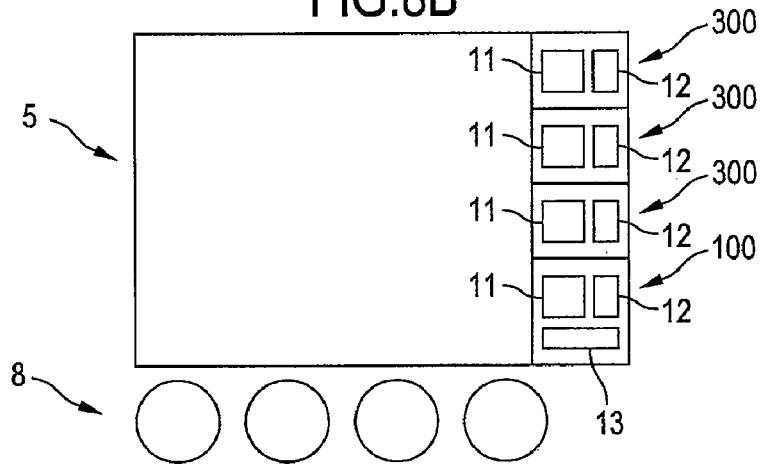
Figure 8C:
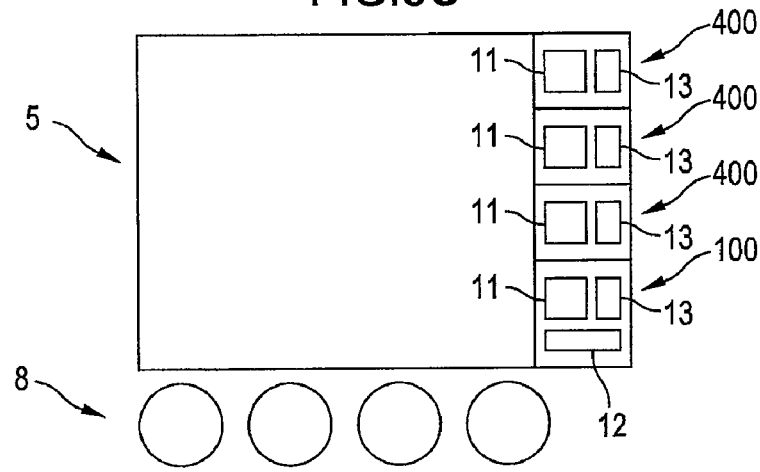

For example, a single liquid developer cartridge 100 may be provided with the accommodating units 11, 12, and 13, while the remaining three liquid developer cartridges 200 are provided with only the liquid developer accommodating unit 11, as illustrated in FIG. 8A. Alternatively, a single liquid developer cartridge 100 may be provided with the three accommodating units 11, 12, and 13, while the remaining three liquid developer cartridges 300 are provided with only the accommodating units 11 and 12, as illustrated in FIG. 8B. Alternatively, a single liquid developer cartridge 100 may be provided with the three accommodating units 11, 12, and 13, while the remaining three liquid developer cartridges 400 are provided with only the accommodating units 11 and 13, as illustrated in FIG. 8C.

Since at least the single liquid developer cartridge 100 is integrally provided with a plurality of accommodating units in these variations, it is not necessary to purchase or replace cartridges accumulating, for example, only the liquid carrier or only the waste liquid developer other than the liquid developer cartridge 100. In other words, it is possible to reduce the types of cartridges used as consumables, thereby reducing the operational and economical burden on the user.

Further, by providing a plurality of accommodating units in at least one liquid developer cartridge 100 (see FIG. 8A), it is possible to reduce the overall cost of the four liquid developer cartridges. Further, when the accommodating units 11, 12, and 13 are not provided in all four liquid developer cartridges, the number of the outlet 15 or the outlet 19 or inlets 16 is reduced, thereby reducing the number of connecting parts between the four liquid developer cartridges and the main casing 2. Hence, this construction reduces the number of parts from which leaks may occur.

Of the four liquid developer cartridges, the liquid developer cartridge 100 integrally provided with the accommodating units is preferably disposed nearest the regulating section 8 (regulating tank 80), as shown in FIG. 8A. This configuration can reduce the load on the pumps P1, P2, and P5 and can suppress power consumption. Further, since it is possible to employ small pumps, this configuration contributes to a compact size of the color printer 1 and further suppresses power consumption.

In the embodiment described above, the outlets 15 and 19 are formed on the bottom surfaces 11A and 12A of the accommodating units 11 and 12, respectively, but the present invention is not limited to this configuration. For example, the outlets may be formed near the bottom of a side wall in the accommodating unit 11 or the accommodating unit 12. The positions for forming the outlet 15 of the liquid development accommodating unit 11 may be the same for the outlet 19 of the liquid carrier accommodating unit 12 or may be different.

In the embodiment described above, the inlet 16 is formed in the side wall 13A of the waste liquid developer accommodating unit 13, but the present invention is not limited to this construction. For example, the inlet may be formed in the top surface of the accommodating unit 13. This configuration is also advantageous in that the cost of the seal can be reduced and the waste liquid developer is less likely to leak from the inlet than when the inlet is provided in the bottom of the accommodating unit 13.

In the embodiment described above, the liquid developer accommodating unit 11 accumulates a liquid developer with a higher concentration than that of the liquid developer stored in the first reservoir 51A of the process unit 50, but the present invention is not limited to this configuration. For example, the liquid developer accommodating unit 11 may accumulate liquid developer having the same concentration stored in the first reservoir 51A. In this case, it is possible to employ a structure for supplying liquid developer accumulated in the accommodating unit 11 directly to the reservoir when there is no need to adjust the concentration, thereby improving the efficiency for supplying liquid developer.

In the embodiment described above, the liquid carrier accommodating unit 12 accumulates a liquid carrier, but the present invention is not limited to this configuration. For example, the accommodating unit 12 may accumulate liquid developer having a concentration lower than that of the liquid developer stored in the first reservoir 51A of the process unit 50. In this case, an agitating member is preferably provided in the accommodating unit 12.

In the embodiment described above, liquid developer is indirectly supplied from the supply roller 52 to the photosensitive drum 57 via the developing roller 54, but the present invention is not limited to this configuration. For example, liquid developer may be supplied directly from the supply roller to the photosensitive drum.

In the embodiment described above, an agitator 14 having a shaft 14A and two agitating blades 14B is employed in the liquid developer accommodating unit 11, but the present invention is not limited to this configuration. That is, any agitating member well known in the art may be suitably employed, provided that the agitating member can agitate the liquid developer accumulated in the liquid developer accommodating unit 11.

In the embodiment described above, the gears 17 and 18 are employed for transmitting a drive force, but the present invention is not limited to this configuration. For example, the drive force may be transmitted with a single gear or three or more gears. It is also possible to employ a drive force transmission mechanism configured of a belt or pulleys rather than gears.

In the embodiment described above, the supply roller 52 and photosensitive drum 57 are employed to convey developer, but the present invention is not limited to this configuration. In other words, the supply roller 52 of the present invention may be any member capable of directly receiving liquid developer from the reservoir, and is not limited to a supply roller. Further, The photosensitive drum 57 may substitute a photosensitive belt, for example. Further, the photosensitive drum 57 is not particularly limited to described above, provided that the member is capable of carrying a toner image on the surface thereof.

While the color printer 1 in the embodiment described above serves as the image-forming device of the present invention, the present invention is not limited to this example. The present invention may be applied to a multifunction device or photocopier employing a liquid development system. Further, the liquid developer cartridge of the present invention may be applied to a monochromatic printer, multifunction device, and photocopier.

What is claimed is:

1. An image forming device comprising:

a plurality of developer cartridges configured to hold therein liquid developer including developing agent and liquid carrier;

a plurality of developing agent bearing members configured to bear the liquid developer;

and a plurality of reservoirs each fluidly connected to an associated one of the developer cartridges, wherein the plurality of reservoirs are configured to store the liquid developer to be supplied to the developing agent bearing members, wherein at least one of the developer cartridges comprises:

a first accumulating section configured to hold therein first liquid developer and to fluidly connect to an associated one of the reservoirs;

a second accumulating section configured to fluidly connect to an associated one of the reservoirs and to hold therein one of the liquid carrier and second liquid developer having a developing agent concentration ratio lower than a developing agent concentration of the first liquid developer; and a third accumulating section that accumulates therein a waste developing agent remaining on a plurality of image bearing members after an image transfer to an image recording medium, and wherein each of one or more remaining developer cartridges comprises one of:

(a) the first accumulating section, (b) the first accumulating section and the second accumulating section, and (c) the first accumulating section and the third accumulating section.

2. The image forming device according to claim 1, further comprising:

the plurality of image bearing members configured to form a visible developing agent image with the developer agent supplied from the plurality of developer agent bearing members, wherein the image forming device is configured to perform the image transfer including transferring the visible developing agent image to the image recording medium.

3. The image forming device according to claim 1, further comprising a sheet cassette detachably mountable in a casing of the image forming device, the sheet cassette configured to store a stack of recording sheets, the plurality of developer cartridges being configured to detach from and attach to the casing in a direction in which the sheet cassette is detachable and mountable.

4. The image forming device according to claim 1, wherein one of the developer cartridges is disposed at a position closer to the reservoirs than other ones of the developer cartridges.

5. The image forming device according to claim 1, further comprising a plurality of regulating units each configured to fluidly connect to an associated one of the reservoirs, each regulation unit configured to regulate a developing agent concentration ratio of the first liquid developer supplied from the plurality of developer cartridges to a regulated concentration, so that each reservoir holds therein liquid developer provided with the regulated concentration, and so that the plurality of developing agent bearing members carry liquid developer provided with the regulated concentration.

6. The image forming device of claim 1, wherein the first accumulating section has a bottom portion provided with a first outlet allowing the first liquid developer to flow out therethrough, and a first guide portion having a funnel shape, wherein the first guide portion is configured to introduce the first liquid developer toward the first outlet, wherein the second accumulating section has a bottom portion provided with a second outlet allowing one of the liquid carrier and the second liquid developer to flow out therethrough, and a second guide portion having a funnel shape, the second guide portion being configured to introduce one of the liquid carrier and the second liquid developer toward the second outlet.

* * * * *